United States Patent [19]

Wyatt

[11] Patent Number: 4,463,803

[45] Date of Patent: Aug. 7, 1984

[54] DOWNHOLE VAPOR GENERATOR AND METHOD OF OPERATION

[75] Inventor: William G. Wyatt, Arlington, Tex.

[73] Assignee: Trans Texas Energy, Inc., Dallas, Tex.

[21] Appl. No.: 349,653

[22] Filed: Feb. 17, 1982

[51] Int. Cl.[3] ..... E21B 36/02

[52] U.S. Cl. ..... 166/59; 166/303; 122/31 R; 431/158

[58] Field of Search ..... 166/57, 59, 302, 303; 60/39.55; 122/31 R, 31 A; 126/360 A; 431/158, 4, 243, 190

[56] References Cited

U.S. PATENT DOCUMENTS

| | | | |
|---|---|---|---|
| 3,315,745 | 4/1967 | Rees, Jr. | 166/59 |
| 3,980,137 | 9/1976 | Gray | 166/59 |
| 4,058,164 | 11/1977 | Stoddard et al. | 166/303 |
| 4,159,743 | 7/1979 | Rose et al. | 166/59 |
| 4,205,725 | 6/1980 | Howard et al. | 166/59 |
| 4,336,839 | 6/1982 | Wagner et al. | 166/59 |
| 4,366,860 | 1/1983 | Donaldson et al. | 166/303 |
| 4,372,386 | 2/1983 | Rhoades et al. | 166/303 |
| 4,378,846 | 4/1983 | Brock | 166/303 |

*Primary Examiner*—Stephen J. Novosad
*Assistant Examiner*—William P. Neuder
*Attorney, Agent, or Firm*—Thomas L. Cantrell; Joseph H. Schley; Stanley R. Moore

[57] ABSTRACT

Disclosed is a method and apparatus for generating high pressure steam within a well bore. The steam vapor generator is constructed for receiving and mixing high pressure water, fuel and oxidant in a down-hole configuration. High pressure water is received within a heat exchanger constructed around a combustion chamber in an annular sleeve configuration and heated through a thermal wall region forming a lower portion thereof. The combustion chamber utilizes the heat energy of radiation to heat the water flowing in the annular sleeve to the point of steam. The heat exchanger further includes a series of open ended flow tubes which triplicate the length of the flow path of the water prior to egressing from the sleeve. A collection chamber is provided beneath the combustion chamber in communication with the heat exchanger for the mixing of the high pressure vapor and the exhaust thereof into the adjacent well formation.

15 Claims, 3 Drawing Figures

DOWNHOLE VAPOR GENERATOR AND METHOD OF OPERATION

BACKGROUND OF THE INVENTION

The invention relates to vapor generators and, more particularly, to a downhole vapor generator utilizing the combustion of air and fuel to radiantly and convectantly heat water for the creation of steam and the pressurized injection thereof into adjacent down-hole hydrocarbon formations.

Many forms of stimulation processes have been employed for increasing productivity of hydrocarbon deposits such as oil and gas wells. The devices utilized in such stimulation processes generally include the generation of both heat and pressure to lower the viscosity of adjacent petroleum, eliminate deposits of materials such as paraffin and impart flow to an adjacent production well. Many processes utilizing such concepts have been employed and/or taught in the prior art. One apparatus is shown and described in U.S. Pat. No. 3,315,745 which discloses a bottom hole burner for introducing heat directly into a downhole formation. The burner comprises a combustion chamber for the mixing of fuel and air and the in situ combustion thereof within the well. An ignition device is provided in the upper end of the combustion chamber. The combustion creates a high pressure level and hot gases are emitted as long as combustion is maintained. These devices are useful for sustaining in situ combustion from oil in the formation surrounding the well.

Another down-hole heating technique is set forth and described in U.S Pat. No. 3,980,137, issued Sept. 14, 1976 to William W. Gray, which discloses a steam generation and injection system. Oil and gas well production has been shown to be increased by pumping pressurized steam directly into the well as compared to the in situ down-hole combustion technique set forth above. The injection of steam not only heats the formation but also facilitates the elimination of deposits of materials such as paraffin as well as dissolving obstructions that impede the flow of petroleum products in such formations into producing wells. It has been shown that an increase in reservoir temperature from 81°. Fahrenheit to 200° Fahrenheit results in a 27 fold decrease in crude coil viscosity. A decrease in the viscosity affords an increase in the free flowability of what otherwise would be termed as "frozen" oil.

Steam injection systems of the prior art have incorporated fuel-air mixtures delivered to combustion chambers of various designs disposed in downhole configurations. Steam is generally generated from water delivered directly into the combustion chamber where it is converted into vapor. The temperature and pressure of the vapor passing from the combustion chamber is then controlled by adjusting the flow rate of the fuel-air mixture as well as the flow rate of coolant, or water, delivered thereto. Heat transfer to feed water in such combustion chambers is effected primarily by conduction rather than through radiation heating from the flame. Such combustion is often stoichiometric and generally sustained by a mixture of hydrogen and oxygen. Since hydrogen combustion creates very little radiant heat, such systems prevent over-heating of the adjacent well casing which can deleteriously occur with escape of radiant energy from less advanced down-hole combustion apparatus.

The general problems of prior art methods and apparatus for downhole burners have included the overheating of adjacent well casing, inefficient heat dissipation, operation cost, efficiency and reliability. It would be an advantage to use fuels less expensive than hydrogen due to the enormous related expense of secondary recovery operations. However, an efficient and reliable system must be provided for down-hole use.

The creation of steam by vapor generators encompasses a wide range of prior art technology. For example, early torpedo designs have utilized vapor generators for propulsion. One such structure is described in British Pat. No. 140,156 accepted Mar. 23, 1920. The vapor generator set forth in the British reference utilizes steam and the products of combustion for creating kinetic energy to drive the torpedo. The fuel is burned under suitable pressure in a combustion chamber. At one end of the chamber the burners are situated while the other end the chamber is open to mixing. Water is supplied to an annular space surrounding the combustion chamber. Water flowing through the annular space cools the combustion chamber walls while being heated. The flame from the burner fills the combustion chamber and the flames strike the water egressing from the annular space converting the preheated water into steam.

The aforesaid concept has been incorporated into several varieties of downhole steam injector structures. A more recent construction is set forth in U.S. Pat. No. 4,243,098 issued Jan. 6, 1981 to Thomas Meeks, et al. This reference teaches the use of a closed tubular flow path within an annular heat exchanger. The tubular array carries the water to be heated along the wall of the combustion chamber of the vapor generator. This closed system approach provides an alternative method to the open flow technique set forth in the Gray patent, while utilizing a similar direct flame engagement process.

In a downhole well bore application, certain aspects of vapor generation are critical and must be closely controlled. For example, gases can become trapped in the coolant, or feed water. These gases which may come from a number of sources, can bubble out causing vapor-lock in a closed system and/or separate the coolant from chamber walls in an open system. Such conditions can lead to serious over-heating of the heat exchanger. For example, the older torpedo concept described above is effective in the generation of steam from closed, annular heating region about a combustion chamber, but there is ample room to dissipate excess heat. The particular water, chemical, mineral compositions found in down-hole operations which contribute to out gassing thus necessitate improvements to certain of the aforesaid steam generator designs of the prior art.

It would be an advantage therefore to provide a downhole vapor generator having improved features of out-gas control, maximization of heat generation and minimal heat dissemination into the adjacent well bore casing. The vapor generator of the present invention provides such a method and apparatus by incorporating a combination closed-open flow system in a concentrically aligned combustion and feed system having an annular heat exchanger about a segregated, centralized combustion zone. The water within the annular heat exchanger flows through a semiopen tubal array and is heated through a segregated thermal radiation zone rather than brought into direct contact with the flame and prior to mixing with the products of combustion in the combustion chamber, for egressing into the adjacent hydrocarbon formation.

SUMMARY OF THE INVENTION

The invention relates to a downhole vapor generator and method of creating steam in a high pressure configuration adjacent hydrocarbon formations. More particularly, the subject invention comprises an improved downhole vapor generator heat exchanger of the type constructed for injecting steam and hot gases from water and gases present in the water into a well bore formation. The vapor generator unit is of the type which is secured within a well bore and supplied with fuel, air, and water for the creation of steam and hot gases. The steam and gases are exhausted under pressure into an adjacent well bore formation. The improvement of the present invention comprises a heat exchanger including an open ended tubular array secured in an annular water sleeve cylindrically encompassing a combustion chamber within the vapor generator. The tubular array includes a first tubular network longitudinally disposed along the length of the water sleeve with the lower end open to supply water to the water sleeve. A second tubular network is longitudinally disposed along the length of the water sleeve with the upper end open to receive out-gasing from the water as well as steam and water in the process of being heated and egressing therefrom. Unvaporized water flowing down the second tubular network is likewise exposed to the adjacent combustion chamber heat and is vaporized prior to emission.

In another aspect the invention includes a method of generating steam within a well bore with a vapor generator disposed therein. The method comprises the steps of delivering a combustible fuel, oxygen, and water to the vapor generator within the well bore and mixing the fuel and oxygen within the combustion chamber adjacent the heat exchanger. The fuel and air mixture is ignited within the combustion chamber by a spark generator disposed within the well bore and combustion is sustained in the combustion chamber for generating radiant heat. Water is passed around the combustion chamber partially through an open ended tubular array disposed within an annular sleeve for absorbing radiant heat from combustion within the inner combustion chamber. The water is thereby converted into steam. A portion of the tubular array provides a means for egress of gases emitted by the water while being heated within the vapor generator as well as steam formed therein. The tubular array also supplies water to the lower portion of the annular sleeve where maximum heating can be effected through a double reversed flow pattern. The steam and hot gases which are then produced are available for injection into adjacent well bore formations.

In yet another aspect, the invention includes apparatus for generating steam within a well bore. The apparatus is of the type including a vapor generator disposed within the well bore having a heat exchanger constructed around a combustion chamber for heating water supplied from the wellhead and the gases present in the water to produce steam and hot gases for injection into a formation adjacent the well bore. The apparatus comprises a generally cylindrical combustion chamber having an annular heat exchanger secured therearound and within the vapor generator. Means are provided for delivering a combustible fuel, oxygen, and water to the area of the combustion chamber within the well bore. An upper mixing chamber is disposed above the combustion chamber and is provided in communication with the fuel-oxidant delivery means for mixing the fuel and oxidant.

Ignition means are disposed within said mixing chamber for igniting the fuel and air mixture to initiate combustion. The annular heat exchanger includes a first, open ended tubular array for flowing water in a first direction about the combustion chamber. Means are then provided for flowing water in a second direction about the combustion chamber which is substantially opposite to the first direction for establishing a water level therein and absorbing the radiant heat from combustion occurring within the combustion chamber and converting the water into steam. Means are next provided for flowing the steam, water, and gases present in the water and emitted by the water when heated within the heat exchanger in a third direction substantially opposite the second direction and into a mixing region beneath the combustion occurring within the combustion chamber. Finally, means are provided for exhausting the steam and gas mixture from the vapor generator into the well bore formation.

BRIEF DESCRIPTION OF THE DRAWINGS

For a more complete understanding of the present invention and for futher objects and advantages thereof, reference may now be had to the following description taken in conjunction with the accompanyin drawings, in which.

DETAILED DESCRIPTION

Figure 1:
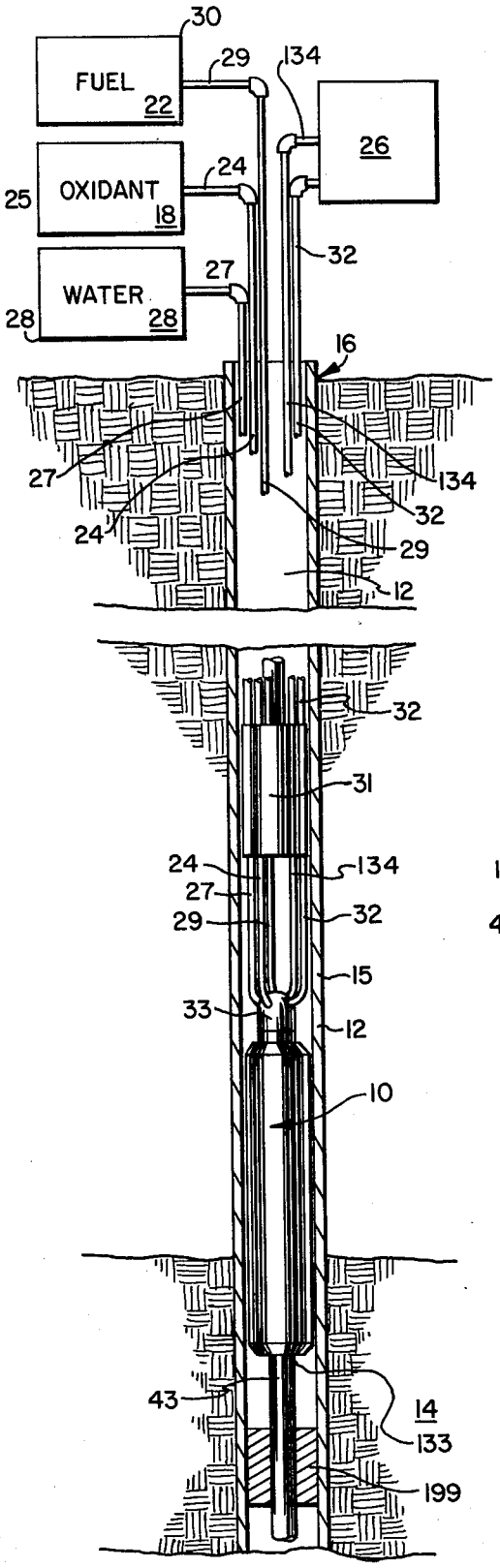
FIG. 1 is a diagrammatic, side-elevational view of a well bore with a vapor generator mounted therein and constructed in accordance with the principles of the present invention.

Referring first to FIG. 1, there is shown a diagrammatic view of one embodiment of the method and apparatus of the present invention. A vapor generator 10 constructed in accordance with the principles of the present invention is shown positioned within a well bore 12 in a down-hole configuration adjacent to the desired formation 14. A well casing 15 lines the wall of the well bore 12 through the formation 14 to the top of the well head 16. At the well head 16 there is supplied oxidant in the form of pressurized air 18, pressurized water 20, fuel 22, and electrical power for combustion in the downhole generator 10. The vapor generator 10 in its downhole position then receives the fuel, oxidant and water 22, 18 and 20 respectively and mixes said elements in the presence of electrically ignited combustion and radiant heat to create high pressure steam which is emitted from the generator 10 into the formation 14. This step greatly facilitates secondary hydrocarbon recovery and may be used in related well bore operations.

Addressing now the area of the well head 16 of FIG. 1, an oxidant supply line 24 is provided and extends from a pressurized tank 25 into the well bore 12 to the generator 10. A series of low pressure and high pressure pumps (not shown) may be used with the supply lines to generate suitably higher downhole pressures). Several oxidants may also be used including air, and hereinafter the term "air" will be used as meaning any conventional oxidant adapted for downhole combustion with a fuel. Water line 27 is next shown extending from a water storage tank 28 into the well bore 12. It should be seen that these supply lines are diagrammatically shown and in fragmentary form for purposes of clarity. Line 27, for example, terminates beneath the well head 16 to facilitate illustration of the various lines and cables which extend to the generator 10. A fuel line 29 likewise extends from a conventional fuel storage tank 30 into the well bore 12.

Still referring to FIG. 1, there is shown above the vapor generator 10, a spark generator 31 for providing high voltage power to ignite the generator 10. A power cable 32 is thus shown connecting the spark generator 31 to a control station 26 situated at the well head 16. The control station 26, of the present invention, is constructed to provide high current, low voltage, power to the downhole spark generator 31 where a high voltage current may be communicated with ignition means within the vapor generator 10. The control station then monitors the combustion by means of one or more thermocouples, disposed in, and/or upon the vapor generator 10. A thermocouple 133 is preferably disposed upon the exhaust part of the generator 10 as will be explained in more detail below. In this manner the commencement and monitoring of combustion in the downhole configuration shown may be implemented without the necessity of high voltage power lines extending downhole. High voltage power presents a greater risk of shorting and downhole failure. The spark generator 31 of the present invention thus alleviates this problem and may be comprised of a conventional electronic spark generation circuitry which is encased in a high pressure chamber for protection from the extremes of a downhole environment. The chamber is also constructed of a suitably small diameter to permit positioning within the well casing 15, around and/or adjacent the necessary supply lines. The supply lines 24, 27, and 29 are routed through and/or around the spark unit 31.

Beneath the spark generator 31, supply lines 24, 27, and 29 are coupled into a single tubular concentric feed line for supplying the constituents for combustion and steam generation in the unit 10. Air line 24 is thus shown to merge in a conventional concentric pipe head coupling at an upper end 33 of the generator 10 with water line 27 and fuel line 29. In the present embodiment, power line 32 is coupled to air line 24 and fed back to the spark generator 31 where high voltage current is produced and supplied to the vapor generator 10 along a high voltage power line 60 (shown in FIG. 2).

Figure 2:
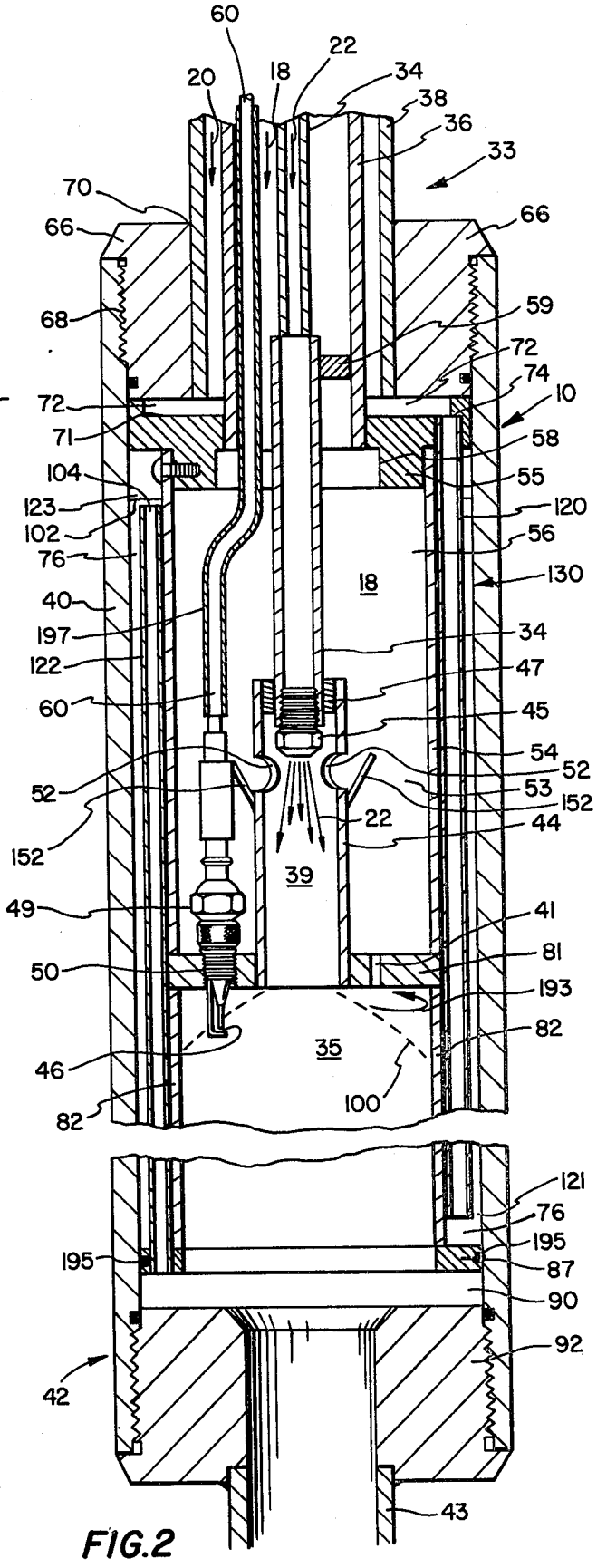
FIG. 2 is an enlarged, cross-sectional, side-elevational view of the vapor generator of FIG. 1.

Referring now to FIG. 2 there is shown an enlarged, side elevational, cross-sectional view of a vapor generator 10 constructed in accordance with the principles of the present invention. At the upper end 33 of the generator 10 conventional coupling means is provided means for connecting the fuel, air, and water lines 29, 24, and 27, respectively, to the generator 10 through concentric passages. A generator fuel line 34 is thus centrally disposed in the upper end 33 of the generator 10, extending downwardly therein to a central combustion chamber 35. An air passage 36 concentrically surrounding fuel line 34 channels air 18 to the area of the combustion chamber 35. Outer casing section 38 thus provides longitudinal structural support for the generator 10. Casing 38 is likewise adapted for containing the flow of water 20 therein from the supply line 27. A series of conventional '0' rings may be provided around the coupling ends of the fuel, air and water lines as set forth and described in co-pending patent application Ser. No. 349208 assigned to the assignee of the present invention.

The intermediate body portion of the vapor generator 10 is constructed with an outer casing 40 which houses the flow passages for the fuel, air and water necessary for operation as well as housing the combustion chamber 35 therein. Lower end 42 of the generator 10 is constructd with an exhaust port 43 for emission of the high pressure steam and gases generated within the unit 10.

In operation, fuel 22 is provided under pressure in fuel tank 30 at the well head 16. The fuel may be liquid propane or the like which is relatively inexpensive compared to certain other fuels utilized in the prior art for downhole combustion. Water 20 is likewise provided under pressure in storage tank 28, and an oxidant such as air 18 is provided under pressure in storage tank 25 and/or from a compressor (not shown). Once the vapor generator 10 has been positioned at the desired location at the formation 14 within the well bore 12, the respective constituents are connected to the supply string 26. A downhole communication link for initiating combustion is comprised of cable 32 connected to spark generator 31. Within the vapor generator 10, air and fuel are permitted to enter the upper combustion chamber 35. The tangential entry of the air 18 through ports 52, as shown by the arrow in FIG. 3, causes turbulence and facilitates mixing of the fuel 22 discharged from the nozzle 45. A spark from the element 46 of the spark plug 49 causes ignition and the creation of flame 100. The flame 100 expands in chamber 80 and radiates heat into the thermal zone of wall portions 84. Water 20 flowing through the upper and lower water sleeves 76 and 86 respectively then absorbs the heat radiated by thermal zone 84. The water 20 thus acts as a coolant to prevent over-heating of the inner wall 82 and casing 40 as well as the creation of the requisite steam and heated water which is emitted through orifices 88 within the lower bulk head 87. Steam and other gases produced by outgasing of the water 20 and preliminary steam generation within the water sleeve is permitted to bubble up and egress from vent tubes 99 to afford efficient and reliable operation of the generator 10. The gases and steam emitted from the water sleeve 86 are then mixed in the lower chamber 90 beneath the combustion zone 80 with the byproducts of combustion of the fuel and air. The vapor mixture is then permitted to egress through the lower bulk head 92 through exhaust port 94. The steam is utilized in filling the area of the casing 15 of the well bore 12 in the region of formation 14. The casing 15 is conventionally perforated in this region to permit the egress of the generated steam into the formation. Similarly, downhole apparatus of conventional design such as packer 199 are utilized to maintain the desired pressure and cause injection of the steam into the select regions of formation 14.

It is thus believed that the operation and construction of the above described vapor generator and the method of operation will be apparent from the foregoing description. While the vapor generator and method of operation thereof shown and described has been characterized as being preferred, it will be obvious that various changes and modifications may be made therein without departing from the spirit and scope of the invention as defined in the following claims.

Addressing now the upper end of chamber 56, the bulk head 55 is formed with a central aperture 58 having secured therein the air pipe 36. A spacer 59 may be utilized to centrally position the fuel line 34 within the air pipe 36. It may be seen that the air pipe 36 terminates at, and is secured to, the bulk head 55. Within air pipe 36, a spark plug connection wire 60 is fed to the spark plug 49 within protective tubing 197, and air 18 is permitted to enter the chamber 56 and around the spark plug 49. Air 18 flows downwardly around the mixing chamber wall 44 within the air sleeve 53 for entry into the chamber 39 through tangential entry ports 52. The construction and angle of ports 52 is selected for producing a vortex of the fuel oxidant mixture of sufficient strength to maximize combustion efficiency. The vortex in chamber 39 is represented by arrow 191. One or more deflectors 152 are also preferably constructed outside the ports 52. An angulated plate construction, as shown in FIG. 2, may be incorporated. The deflectors 152 permit free entry of air into the chamber 39 during normal operation while inhibiting the formation of a reverse flow vortex in air sleeve 53 during an unexpected backfire. Backfires will randomly occur in remotely ignited fuel-oxidant mixtures, and the flow of gases egressing from the tangential ports 52 can create a deleterious vortex in air sleeve 53. A severe vortex can rupture lines such as power cable 60, and thus the utilization of deflector plates affords higher dynamic reliability in long term operation. The protective tubing 197 further protects cable 60.

Still referring to FIG. 2, the outer casing 40 of the generator 10 is terminated at its upper end by an outer bulk head 66, preferably threadably engaged to casing 40 as shown by threaded portion 68. A central aperture 70 formed through the bulk head 66 permits entry of the drill string coupling casing 38 and the fuel, air and water lines therein. Casing 38 is preferably fixedly mounted within the bulk head 66. Spacers other than fuel line spacer 59 are not shown for purposes of clarity. What is shown is bulk head 66 being longitudinally spaced from an upper surface 71 of the intermediate bulk head 55 which forms an entry chamber or passage 72. It may be seen that chamber 72 may also be comprised of a plurality of flow passages formed in the top surface of bulk head 55 rather than spaced from bulk head 66. Water 20, thus flows from pipe 38 to passage 72. Apertures 74 are formed along the outer periphery of the bulk head 55 for allowing water 20 in passage 72 to flow into an annular space formed between outer casing walls 40 and intermediate walls 54 to comprise an annular water jacket or sleeve 76. Within this annular sleeve 76, an array of flow tubes is provided. A first series of downwardly directed feed tubes 120 is provided in connection with apertures 74 for directing water flow from chamber 72 into the lower end 121 of sleeve 76. A second series of downwardly directed exhaust tubes 122 is provided for channeling water and steam from an upper portion 123 of the sleeve 76 downwardly through a lower bulk head 87. Water 20 may thus be seen to flow downwardly into sleeve 76, upwardly in said sleeve and into exhaust tubes 122. In this manner the water 20 is effectively and efficiently heated and converted into high pressure steam.

Figure 3:
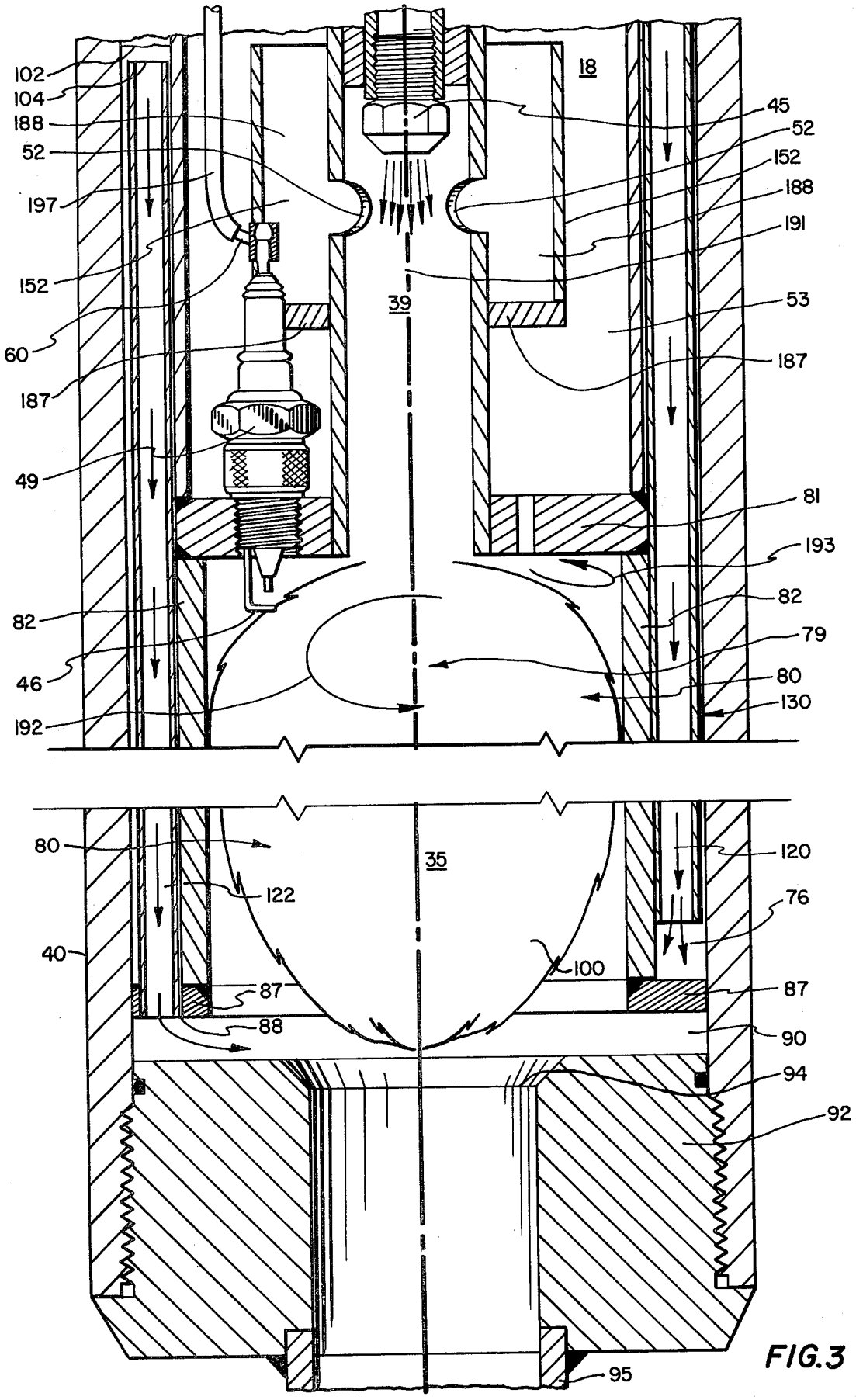
FIG. 3 is an enlarged, cross-sectional, fragmentary view of the vapor generator of FIG. 2 illustrating one aspect of operation thereof.

Referring now to FIG. 3, there is shown an enlarged view of the intermediate region of the generator 10 comprising a heat exchanger 130. The heat exchanger 130 includes the sleeve 76 and tubular arrays 120 and 122 therein, secured around combustion chamber 35. The combustion chamber 35 includes a central flame region 79 and outer heat generation, thermal zone 80. Combustion chamber 35 may be seen to be constructed with an increased diameter relative to mixing chamber 39, for permitting expansion of the mixture of gases and full combustion of the air and fuel constituents. Thermal zone 80 of chamber 35 is constructed with cylindrical, outer chamber walls 82 terminating at the top at bulk head 81 and at the bottom at sleeve bulk head 87. The walls 82 thus form the lower region of water jacket 76 wherein maximum heating of the water 20 is effected.

The increased diameter of chamber 35 allows the vortex 191 egressing from chamber 39 to expand, which expansion reduces the angular velocity of the mixture for ignition. The expanding vortex 192 of chamber 35 then produces low pressure areas and a "toroidal" vortex area 193 adjacent bulkhead 81. These flow patterns function as a flame holder to maximize the efficiency and reliability of combustion.

It may be seen that an alternative embodiment of deflectors 152 are shown in FIG. 3. Deflector tubes 188 (shown in a fragmentary side elevational view) surround each aperture 52 and are closed at the bottom with plug 187. Each tube 188 is open at the top for discharging any backfire upwardly and away from spark plug 49. In particular, the tubular configuration of deflectors 152 prevent the formation of deleterious vortex flows in chamber 53.

It may also be seen that the heat exchanger 130 is fed by the combustion occurring in chamber 35, via radiation through walls 82. The water 20 within the sleeve 76 and tubular arrays 120 and 122 is thus heated to the point of steam formation. Apertures 88 are formed through the bulk head 87 for receiving tubes 122 releasing the steam formed within the heat exchanger 130. The steam from heat exchanger 130 and the flame from combustion in chamber 35 is permitted to exhaust into a chamber 90 formed beneath bulk head 87 and above a lower casing bulk head 92, terminating the lower end of the generator casing 40. A central aperture 94 is formed through the bulk head 92 for receiving an emission exhaust pipe 95 which forms a means of egress for the steam and gases generated within the upper generator portions.

Referring now to FIGS. 2 and 3 in combination, and particularly the heat exchanger 130, each tubular array 120 and 122 includes a plurality of tubes preferrably disposed symetrically around the combustion chamber 35 for receiving and venting water, steam and gaseous by-products. The introduction of water 20 into the water jackets 76 has been shown to produce out-gassing of dissolved gases in the water through pressure drop phenomenona. Preliminary vaporization of the water 20 in upper jacket 76 has also been shown to be an intermittent problem. The gas and vapor can cause vapor-lock as well as over-heating when water is absent from the thermal zone. The exhaust tubes 122 afford a means of egress of such gases and vapor whereby a constant water level 102 is maintained above the thermal zone 80. A top opening 104 of the exhaust tube 122 is thus shown at the water level 102 for exhausting the outgassed by-products, preliminary water vapor, and water.

OPERATION

Fuel 22 is provided under pressure in fuel tank 30 at the well head 16. The fuel may be liquid propane or the like which is relatively inexpensive compared to certain other fuels utilized in the prior art for downhole combustion. Water 20 is likewise provided under pressure in storage tank 28, and air 18 provided under pressure in storage tank 25. Once the vapor generator 10 has been positioned at the desired location at the formation 14 within the well bore 12, the respective constituents are connected to the supply string 26. A control station 26 at the well head 16 is used to initiate the combustion, preferably by activating spark plug 49 through power cables 32 and 60 leading to and from the spark generator 31. The station 26 will also monitor what is occurring downhole by utilization of thermocouples 133 and a communication cable 134 which connects the thermocouple to the Station 26. The thermocouple 133, as shown in FIG. 1, is positioned upon the outside of the exhaust port 43. In such a position the unit may sense the heat produced by the egressing steam without being directly abraded thereby or effected by temperature excursions.

Within the vapor generator 10, air and fuel are permitted to enter the upper mixing chamber 39. The tangential entry of the air 18 through ports 52, as shown by the arrow in FIG. 3, causes turbulence and facilitates mixing of the fuel 22 discharged from the nozzle 45. The fuel-air mixture then egresses into chamber 35. A spark from the element 46 of the spark plug 49 causes ignition and the creation of flame 100 in the combustion chamber 35. It may be noted that the spark ignition element 46 of plug 49 may be positioned relatively close to bulkhead 81 because the expanding flow holds the flame mixture close to the top of the chamber 35. This feature also allows the ignition to occur from a stoichiometric mixture rather than necessitating "choking" for start up. Ignition may also be precipitated from various chemical compositions fed to combustion chamber 35 through the aforesaid supply lines. Such chemical compositions are of conventional design.

The ignited combustion comprising flame 100 fills chamber 35 and thermal zone 80 and radiates heat into the wall portions 82. Water 20 flowing upwardly and downwardly through the heat exchanger 130 comprising water sleeves 76 and tubular arrays 120 and 122 then absorbs the heat radiated by thermal zone 80. The water 20 thus acts as a coolant to prevent over-heating of the chamber wall 82 and casing 40 as well as the creation of the requisite steam which is emitted from the exhaust tubes 122 from the lower bulk head 87. Steam and other gases produced by outgassing of the water 20 and preliminary steam generation within the water sleeve is permitted to bubble up from the end of feed tube 120 and egress from exhaust tubes 122 to afford efficient and reliable operation of the heat exchanger 130 and generator 10. The gases and steam emitted from the heat exchanger 130 are then mixed in the lower chamber 90 beneath the combustion chamber 35 with the by-products of combustion of the fuel and air. The vapor mixture is then permitted to egress through the lower bulk head 92 through exhaust port 94. The steam is utilized in filling the area of the casing 15 of the well bore 12 in the region of formation 14. The casing 15 is conventionally perforated in this region to permit the egress of the generated steam into the formation. Similarly, downhole apparatus of conventional design such as packer 199 are utilized to maintain the desired pressure and cause injection of the steam into the select areas of formation 14.

It is thus believed that the operation and construction of the above described vapor generator and the method of operation will be apparent from the foregoing description. While the vapor generator and method of operation thereof shown and described has been characterized as being preferred, it will be obvious that various changes and modifications may be made therein without departing from the spirit and scope of the invention as defined in the following claims.

What is claimed:

1. A method of generating steam within a well bore with a vapor generator disposed therein of the type having a heat exchanger constructed around a combustion chamber for heating water supplied from the well head and the gases present in the water to produce steam and hot gases for injection into a formation adjacent the well bore, said method comprising the steps of:

providing a combustion chamber with an annulus formed therearound and within said vapor generator;

delivering a combustible fuel, oxidant, and water to the area of said combustion chamber of said vapor generator within said well bore;

injecting said fuel and oxidant within said combustion chamber to provide a combustible mixture;

igniting said fuel and oxidant mixture within said combustion chamber and sustaining combustion therein for generating radiant heat;

flowing water in first direction within said annulus and about said combustion chamber;

providing a first open ended tubular array within said annulus for directing the flow of said water in said first direction;

flowing water in a second direction within said annulus and about said combustion chamber around said first tubular array, said second direction being substantially opposite to and first direction;

absorbing radiant heat from combustion within said combustion chamber by said water flowing therearound and converting said water into steam;

flowing said steam, water and gases present in said water and emitted by said water when heated within said annulus in a third direction substantially opposite said second direction;

providing a second open ended tubular array within said annulus for directing the flow of said water in said third direction;

positioning said open end of said first tubular array in a longitudinally disposed opposite position relative to said open end of said second tubular array and wherein said water is directed to flow in said second direction between said open ends of said tubular arrays and substantially therearound within said annulus;

venting said steam formed within said annulus from said heated water and gases emitted by said water into a mixing region beneath said combustion occuring within said combustion chamber; and exhausting said steam and gas mixture from said vapor generator into said well bore formation.

2. The method as set forth in claim 1 wherein said method further comprises the step of establishing a fluid water level within said annulus of water flowing in said second direction, said water level being established above said combustion chamber for affording a continuous fluid presence within said annulus around said combustion chamber.

3. The method as set forth in claim 1 wherein said step of delivering fuel and oxidant to said combustion chamber includes the step of providing a pre-mixing chamber continuous said combustion chamber and in flow communication therewith and the step of mixing said fuel and oxidant in said pre-mixing chamber.

4. The method as set forth in claim 3 wherein the step of mixing said fuel and oxidant includes the step of tangentially injecting air into said pre-mixing chamber for turbulent mixing with said fuel.

5. The method as set forth in claim 1 wherein the step of delivering the fuel, oxidant, and water to the generator includes the step of providing a tubular pipe section above said combustion chamber, said pipe being concentrically constructed with three flow passages therein and simultaneously channeling the fuel, oxidant and water therethrough.

6. The method as set forth in claim 1 wherein the step of igniting said fuel and air mixture includes the steps of providing a spark generator within the well bore adjacent said combustion chamber, supplying a low voltage current to said generator, providing a high voltage current within said generator and supplying said high voltage current to said combustion chamber.

7. The method as set forth in claim 1 wherein the step of exhausting said steam from said generator includes the steps of providing a thermocouple in the area of said exhausting steam, sensing the temperature thereof, and communicating said temperature to the area of the wellhead for monitoring said steam generation.

8. Apparatus for generating steam within a well bore of the type including a vapor generator disposed therein and having a heat exchanger constructed around a combustion chamber for heating water supplied from the wellhead and the gases present in the water to produce steam and hot gases for injection into a formation adjacent the wellbore, said apparatus comprising;

a generally cylindrical combustion chamber having an annulus formed therearound and within aid vapor generator;

means for delivering a combustible fuel, oxidant, and water to the area of said combustion chamber of said vapor generator within said wellbore;

an upper mixing chamber disposed above said combustion chamber and provided in communication with said fuel, oxidant delivery means for mixing the fuel and oxidant;

ignition means for igniting the fuel and air mixture to initiate a combustion flame;

a first, open ended tubular array disposed in said annulus for flowing water in a first direction about said combustion chamber;

means for flowing water in a second direction within said annulus, about said combustion chamber and said first tubular array which direction is substantially opposite to said first direction for therein establishing a water level within said annulus and absorbing radiant heat from combustion occuring within said combustion chamber and converting said water into steam;

means for flowing said steam, water and gases present in said water and emitted by said water when heated within said heat exchanger in a third direction substantially opposite said second direction and into a mixing region beneath said combustion occurring within said combustion chamber;

a second, open ended tubular array disposed within said annulus for directing the flow of said water in said third direction;

said open end of first tubular array being longitudinally disposed in an opposite position relative to said open end of said second tubular array within said annulus to comprise means for flowing water in said second direction between said open ends of said tubular arrays; and means for exhausting said steam and gas mixture from said vapor generator into said well bore formation.

9. The apparatus as set forth in claim 8 wherein said apparatus further comprises means for establishing a fluid water level within said annulus of water flowing in said second direction, said water level being established above said combustion chamber for affording a continuous fluid presence within said annulus around said combustion chamber.

10. The apparatus as set forth in claim 8 wherein said upper mixing chamber is formed of a cylindrical construction concentrically aligned contiguous the combustion chamber and having a lesser diameter than said combustion chamber for facilitating the expansion of the combustion gases during flow and combustion therein and the retention of said combustion flame adjacent said mixing chamber.

11. The apparatus as set forth in claim 10 wherein said upper mixing chamber includes an outer cylindrical sleeve spaced therearound for the fluid flow of oxidant into said mixing chamber.

12. The apparatus as set forth in claim 11 wherein said mixing chamber includes apertures formed tangentially through the cylindrical side walls thereof for the tangential injection of oxidant for mixing with fuel, and wherein deflector means are disposed outwardly of said apertures for diverting reverse fluid flow from said mixing chamber into said outer sleeve.

13. The apparatus as set forth in claim 8 wherein said delivering means includes a tubular pipe section concentrically constructed and disposed above said combustion chamber with three flow passages therein for simultaneously channeling the fuel, oxidant and water therethrough.

14. The apparatus as set forth in claim 8 wherein said ignition means for said fuel and air mixture includes a spark generator disposed within the well bore adjacent said combustion chamber for transforming a low voltage current supplied to said generator into a high voltage current supplied to said combustion chamber.

15. The apparatus as set forth in claim 7 wherein said means for exhausting said steam from said generator includes an exhaust pipe and a thermocouple secured upon the outside of said pipe for sensing the temperature thereof and communicating said temperature to the area of the wellhead for monitoring said steam generation.

* * * * *